US010767605B2

(12) United States Patent
Yamada et al.

(10) Patent No.: US 10,767,605 B2
(45) Date of Patent: Sep. 8, 2020

(54) HEAT EXCHANGER

(71) Applicant: TOKYO ROKI CO., LTD., Kanagawa (JP)

(72) Inventors: Tatsuto Yamada, Kanagawa (JP); Hajime Fujiki, Kanagawa (JP); Ryota Niimura, Kanagawa (JP); Yusuke Sakata, Kanagawa (JP); Masahiro Kanda, Kanagawa (JP)

(73) Assignee: TOKYO ROKI CO., LTD., Kanagawa (JP)

( * ) Notice: Subject to any disclaimer, the term of this patent is extended or adjusted under 35 U.S.C. 154(b) by 0 days.

(21) Appl. No.: 16/471,719

(22) PCT Filed: Dec. 20, 2016

(86) PCT No.: PCT/JP2016/087924
§ 371 (c)(1),
(2) Date: Jun. 20, 2019

(87) PCT Pub. No.: WO2018/116370
PCT Pub. Date: Jun. 28, 2018

(65) Prior Publication Data

US 2019/0331067 A1 Oct. 31, 2019

(51) Int. Cl.
*F02M 26/29* (2016.01)
*F28D 7/16* (2006.01)
*F28F 9/013* (2006.01)

(52) U.S. Cl.
CPC ..... *F02M 26/29* (2016.02); *F28D 7/16* (2013.01); *F28F 9/013* (2013.01)

(58) Field of Classification Search
CPC ..... F02M 26/29; F28D 7/16; F28F 9/013
See application file for complete search history.

(56) References Cited

U.S. PATENT DOCUMENTS 4,696,342 A * 9/1987 Yamauchi ..... F28D 1/0341 165/152
4,766,952 A * 8/1988 Onodera ..... F22B 37/04 122/391

(Continued)

FOREIGN PATENT DOCUMENTS

CN 1826461 A 8/2006
EP 1647697 A1 4/2006

(Continued)

OTHER PUBLICATIONS

Written Opinion issued in corresponding International Application No. PCT/JP2016/087924 dated Jun. 28, 2018 (7 pages).

(Continued)

*Primary Examiner* — Joseph J Dallo
(74) *Attorney, Agent, or Firm* — Osha Liang LLP

(57) ABSTRACT

A heat exchanger includes: a stack formed by stacking a plurality of tubes through which gas flow; a tubular inner tank in which the stack is housed; and a tubular outer tank that is mounted on the outside of the inner tank so as to define an inner space between the outer tank and an outer peripheral surface of the inner tank. Each of both end portions of the tubes has a thickness greater than each of middle portions of the tubes. The both end portions of the tubes adjacent to each other in the stack are joined together so as to form a clearance between the middle portions of the adjacent tubes in the stack. Outer peripheries of both end portions of the stack are joined to an inner peripheral surface of the inner tank. An introduction hole for introducing a cooling medium is formed in the outer tank.

4 Claims, 16 Drawing Sheets

(56) References Cited

U.S. PATENT DOCUMENTS

| | | | | |
|---|---|---|---|---|
| 2010/0044019 | A1 | 2/2010 | Maeda et al. | |
| 2013/0105127 | A1* | 5/2013 | Postma | F28D 1/053 165/157 |
| 2014/0014077 | A1 | 1/2014 | Schuricht et al. | |
| 2014/0349202 | A1* | 11/2014 | Seo | H01M 8/04126 429/413 |
| 2016/0311311 | A1* | 10/2016 | Choi | F28D 1/0435 |
| 2018/0252475 | A1* | 9/2018 | Zhang | F28F 9/013 |

FOREIGN PATENT DOCUMENTS

| | | | |
|---|---|---|---|
| JP | 5500399 | B2 | 5/2014 |
| JP | 2014081175 | A | 5/2014 |
| JP | 2014-112013 | A | 6/2014 |
| JP | 2014-169857 | A | 9/2014 |
| WO | 2013092641 | A1 | 6/2013 |

OTHER PUBLICATIONS

Office Action issued in corresponding Chinese Patent Application No. 201680091725.3 dated Mar. 20, 2020, with translation (16 pages).

Extended European Search Report issued in the counterpart European Patent Application No. 16924359.9, dated Jun. 9, 2020 (7 pages).

* cited by examiner

HEAT EXCHANGER

TECHNICAL FIELD

The present disclosure relates to a heat exchanger that exchanges heat between gas and a cooling medium.

BACKGROUND ART

Patent Literatures 1 and 2 disclose heat exchangers. Hereinafter, the heat exchangers described in Patent Literatures 1 and 2 will be briefly explained with the reference signs used in Patent Literatures 1 and 2 being given in parentheses.

In the heat exchanger described in Patent Literature 1, flat rectangular-tubular tubes (110) are stacked, and gas passes through inside the tubes (110). Protruding portions (112) are formed at outer edges of a bonding surface of the tube (110), and the protruding portions (112) of the tubes (110) adjacent to each other are joined together such that a flow path (115) surrounded with the protruding portions (112) is formed between the adjacent tubes (110). The protruding portions (112) are not formed in four portions (113*a*, 113*b*) in the outer edges of the bonding surface of the tube (110), and these portions (113*a*, 113*b*) form opening portions in which two opening portions (113*a*) serve as entrances to the flow path (115) and the other two opening portions (113*b*) serve as exits from the flow path (115). The stacked body of the tubes (110) is housed in a tubular water tank (130), and the tubular water tank (130) bulges out around the opening portions (113*a*) serving as the entrances. A pipe hole (132*d*) is formed in a part facing the opening portions (113*a*) of a bulging portion (132*b*), and cooling water is introduced into the bulging portion (132*b*) through the pipe hole (132*b*). Accordingly, the cooling water flows from the bulging portion (132*b*) to the flow paths (115) through the opening portions (113*a*).

In the heat exchanger described in Patent Literature 2, flat rectangular-tubular tubes (110) are stacked, and gas passes through inside the tubes (110). Protruding portions (112) are formed at outer edges of a bonding surface of the tube (110), and the protruding portions (112) of tubes (110) adjacent to each other are joined together such that a flow path (113) surrounded by the protruding portions (112) is formed between the adjacent tubes (110). The protruding portions (112) are not formed in two portions (113*a*, 113*b*) in the outer edges of the bonding surface of the tube (110), and these portions (113*a*, 113*b*) form opening portions in which one opening portion (113*a*) serves as an entrance to the flow path (113) and the other opening portion (113*b*) serves as an exit from the flow path (113). The stacked body of the tubes (110) is housed in a tubular water tank (130). An end portion of the stacked body of the tubes (110) is fitted in an opening portion (146) of an inner gas tank (140B), and an outer peripheral surface of the end portion is joined to an inner peripheral surface of the opening portion (146) of the inner gas tank (140B). This allows gas introduced into the inner gas tank (140B) to flow into the tubes (110). The inner gas tank (140B) is housed in an outer tank (140A), and cooling water is introduced into the outer tank (140A). A joint part at which the stacked body of the tubes (110) and the inner gas tank (140B) are joined together is arranged in an opening of the outer tank (140A). The opening of the outer tank (140A) is connected with an opening of the tubular water tank (130). For the cooling water introduced into the outer tank (140A), a flow path (150) is formed between the outer surfaces of the inner gas tank (140B) and the stacked body of the tubes (110) and the inner surfaces of the outer tank (140) and the tubular water tank (130), and the cooling water introduced into the outer tank (140A) flows into the above-described opening portions (113*a*) through the flow path (150). Accordingly, the cooling water flows into the flow paths (113) each between the tubes (110) adjacent to each other.

CITATION LIST

Patent Literature

[PTL 1] Japanese Patent No. 5500399

[PTL 2] Japanese Patent Application Publication No. 2014-169857

SUMMARY

Technical Problem

However, in the heat exchanger described in Patent Literature 1, the cooling water having passed through the opening portions (113*a*) close to the pipe hole (132*d*) is likely to stagnate around the opening portions (113*a*) on the opposite side. Also in the heat exchanger described in Patent Literature 2, the cooling water flowing into the flow paths (113) from the opening portions (113*a*) is likely to stagnate in a part distant from the openings (113*a*).

Accordingly, both of the heat exchangers of Patent Literatures 1 and 2 have a risk that the stagnated cooling water is heated and boiled by the heat of the gas to damage the heat exchanger due to boiling.

The present disclosure has been achieved in view of the above-described circumstances. An issue to be solved by the present disclosure is to prevent stagnation of a cooling medium such as cooling water.

Solution to Problem

A main aspect of the present disclosure for achieving an object described above is a heat exchanger, comprising: a stack formed by stacking a plurality of tubes through which gas flows; a tubular inner tank in which the stack is housed; and a tubular outer tank that is mounted on the outside of the inner tank so as to define an inner space between the outer tank and an outer peripheral surface of the inner tank, wherein each of both end portions of the tubes has a thickness greater than each of middle portions of the tubes, the both end portions of the tubes adjacent to each other in the stack are joined together so as to form a clearance between the middle portions of the adjacent tubes in the stack, outer peripheries of both end portions of the stack are joined to an inner peripheral surface of the inner tank, an introduction hole for introducing a cooling medium is formed in the outer tank, a discharge hole for discharging the cooling medium is formed at a location between the both end portions of the tubes in the inner tank, and a communication hole allowing the clearance and the inner space to communicate with each other is formed in each of both side surfaces of the inner tank positioned inside the outer tank.

According to the above, since a tubular outer tank defines an inner space between an outer peripheral surface of an inner tank and an inner peripheral surface of the outer tank, a cooling medium flowing into the inner space through an introduction hole easily reach the whole inner space. In addition, since the cooling medium having flown into the inner space flows into a clearance between the middle portions of tubes adjacent to each other from communication holes formed in both sides of the clearance. Accordingly, the cooling medium is not stagnated in the clearance between the middle portions of the tubes.

Advantageous Effects

According to the present disclosure, it is possible to inhibit stagnation of a cooling medium.

DESCRIPTION OF EMBODIMENTS

An embodiment of the present disclosure will be described below with reference to the drawings. Various limitations that are technically preferable to implement the present disclosure are made in the embodiment which will be described later, however, they are not intended to limit the scope of the present disclosure to the following embodiment and the illustrated examples.

1. Configuration of Heat Exchanger

Figure 1:
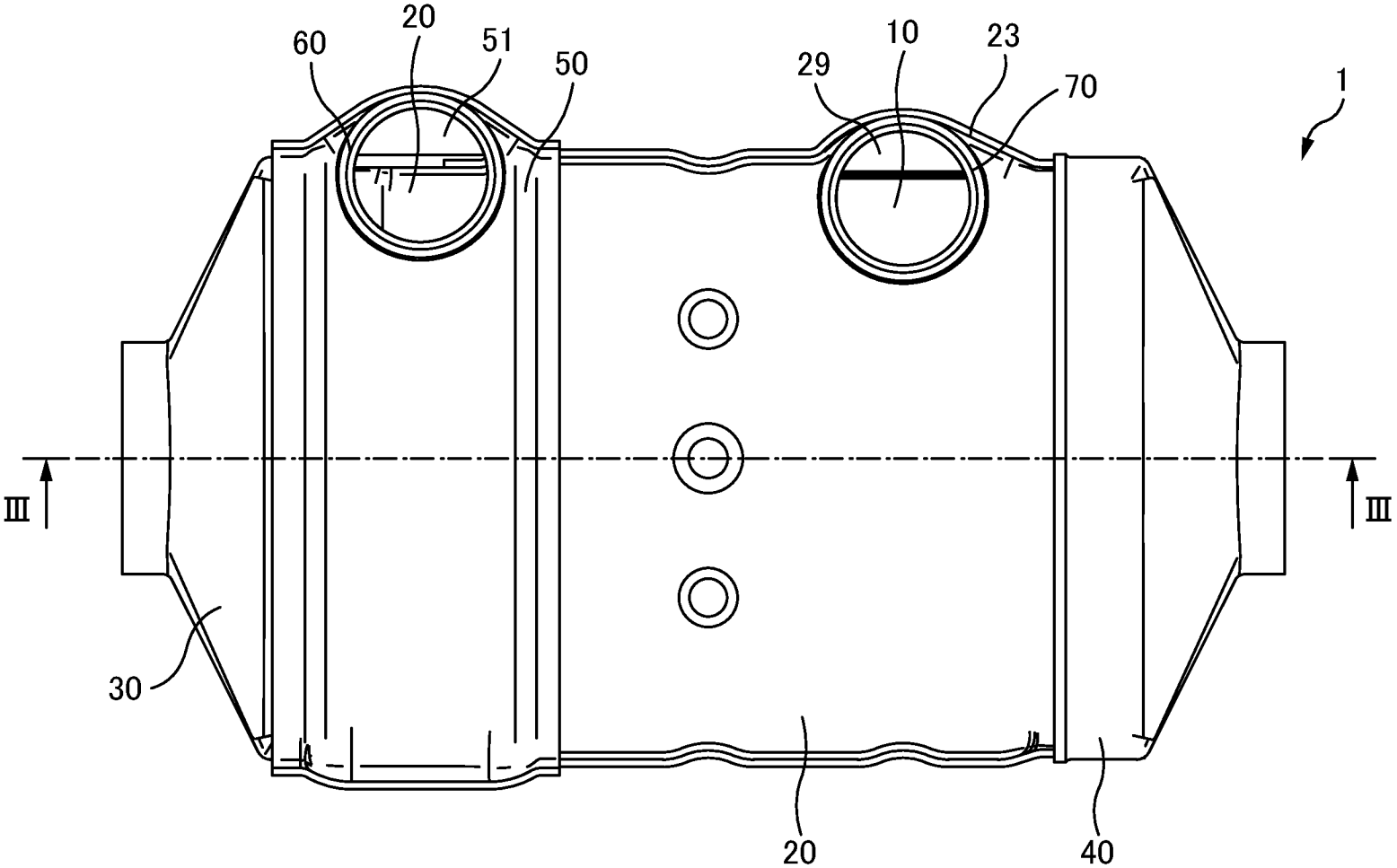
FIG. 1 is a plan view illustrating a heat exchanger.
Figure 2:
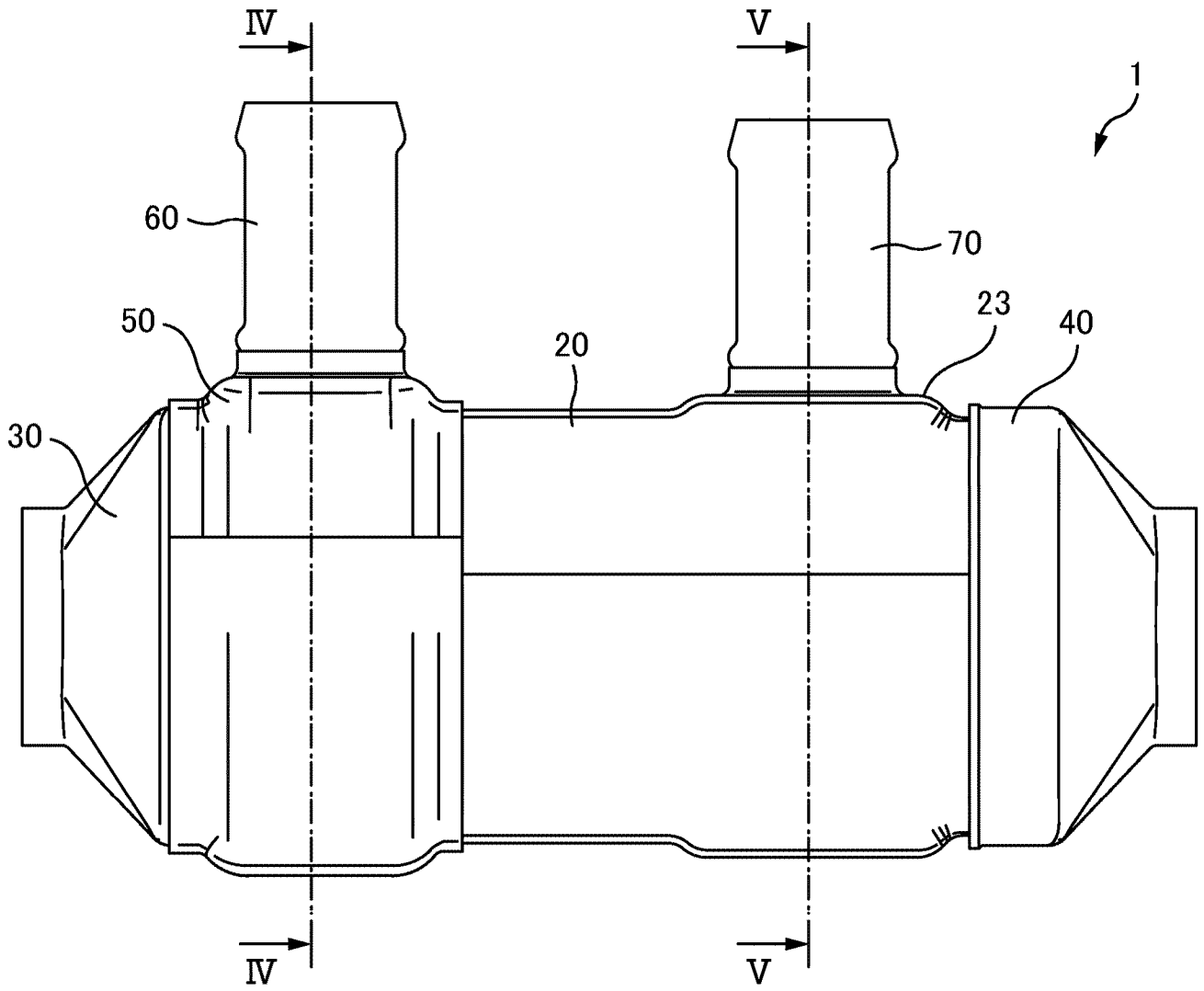
FIG. 2 is a right side view illustrating a heat exchanger.
Figure 3:
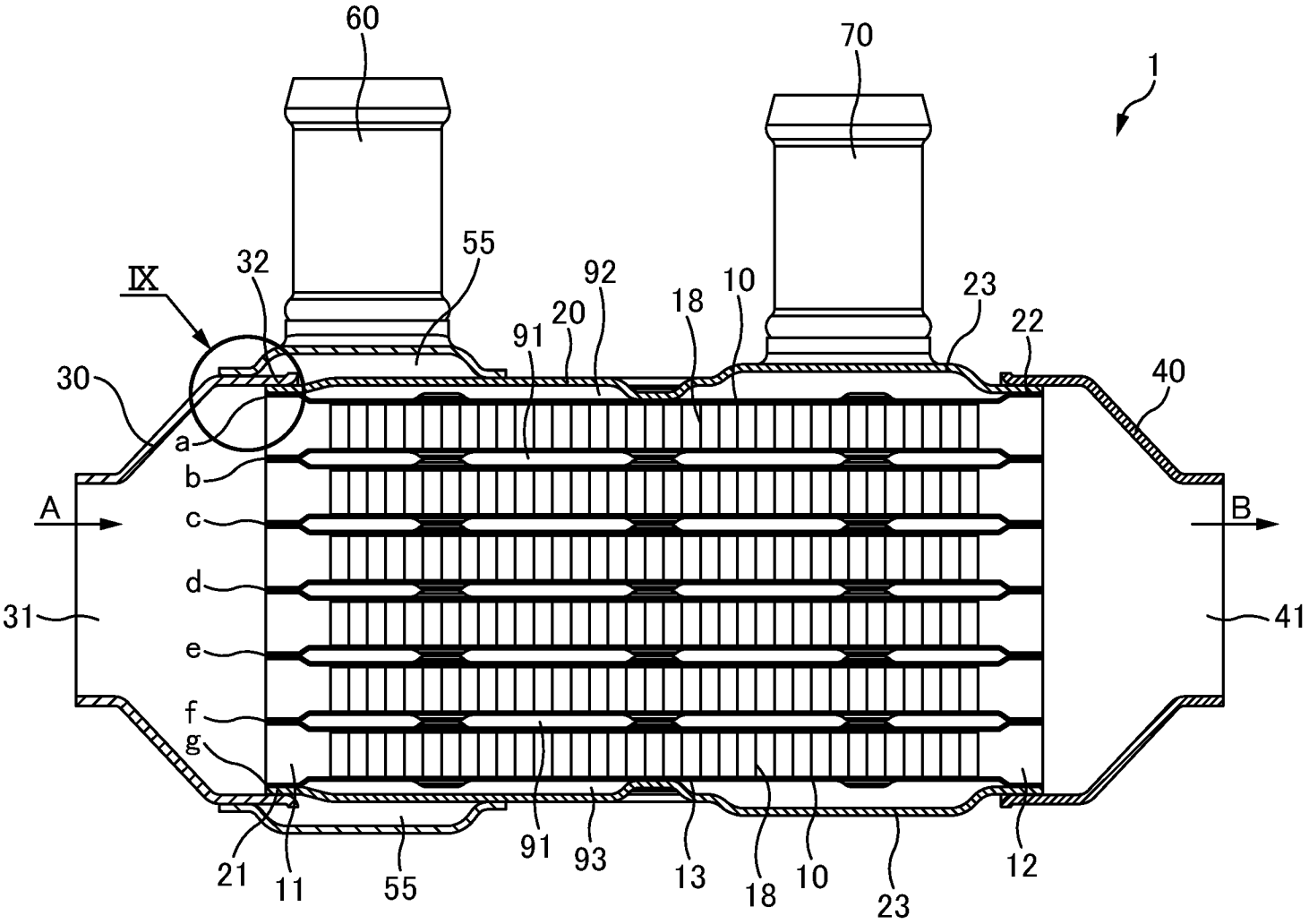
FIG. 3 is a cross-sectional view taken along line III-III of FIG. 1.
Figure 4:
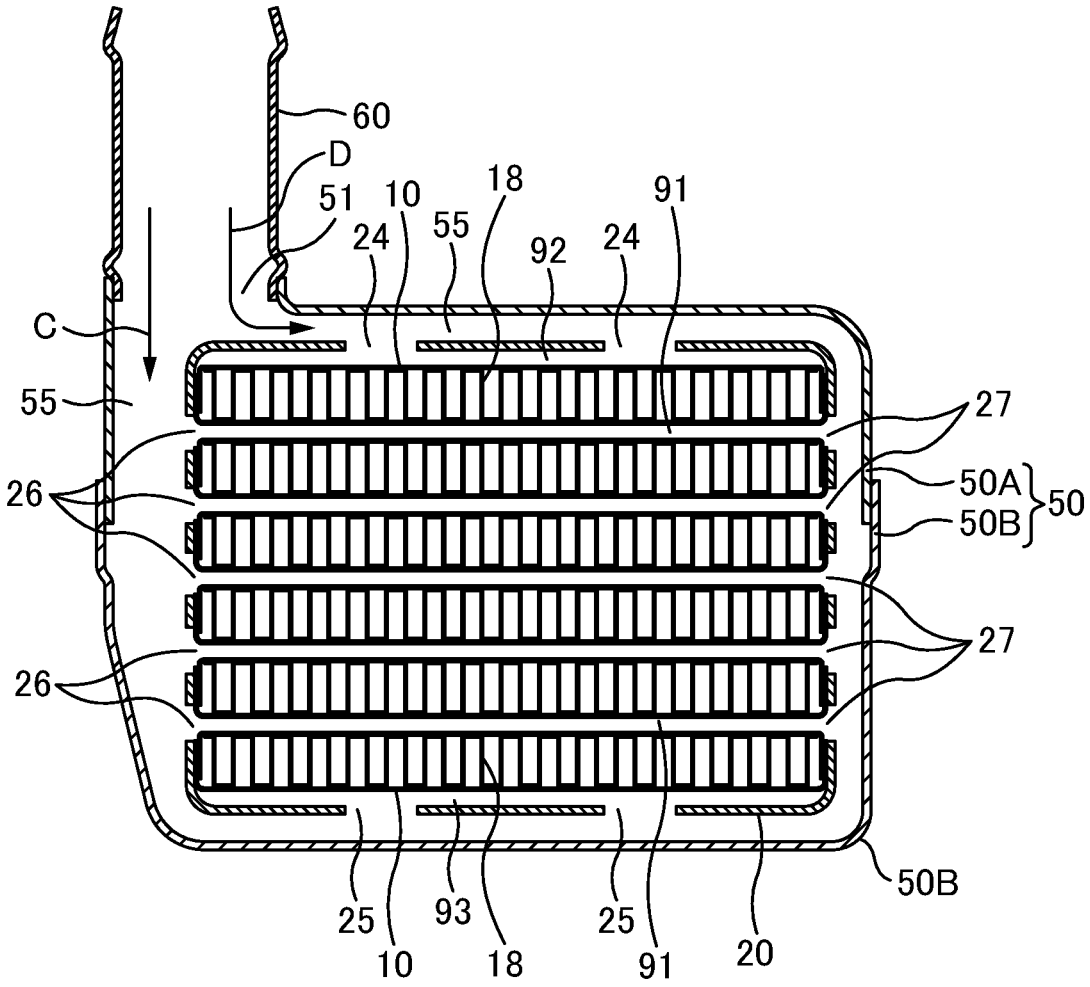
FIG. 4 is a cross-sectional view taken along line IV-IV of FIG. 2.
Figure 5:
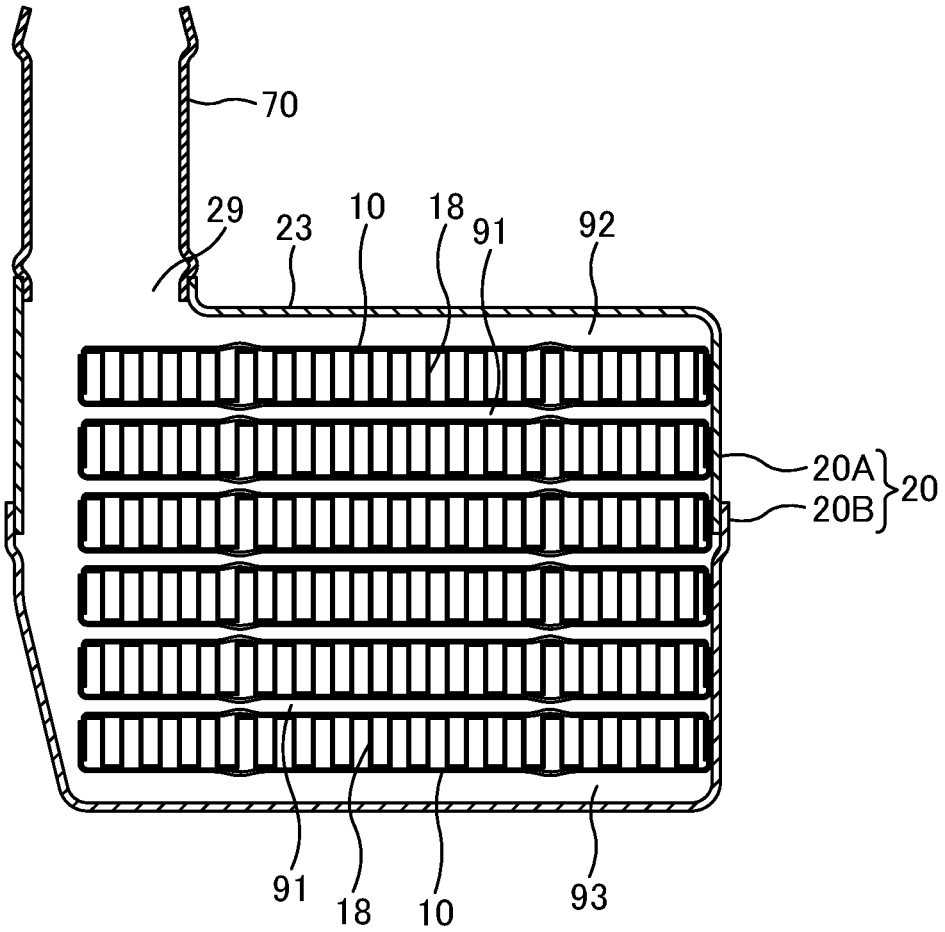
FIG. 5 is a cross-sectional view taken along line V-V of FIG. 2.
Figure 6:
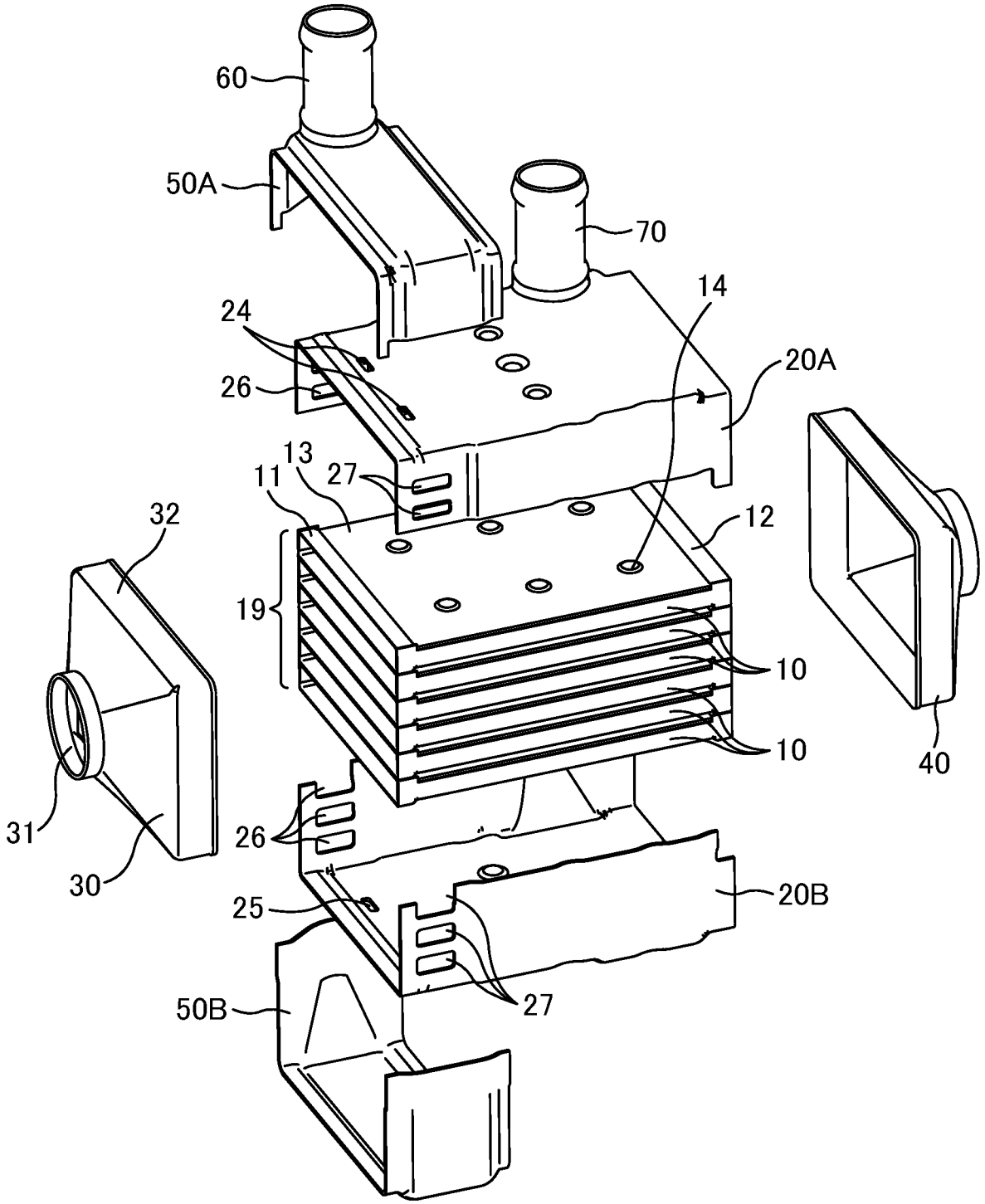
FIG. 6 is an exploded perspective view illustrating a heat exchanger.
Figure 7:
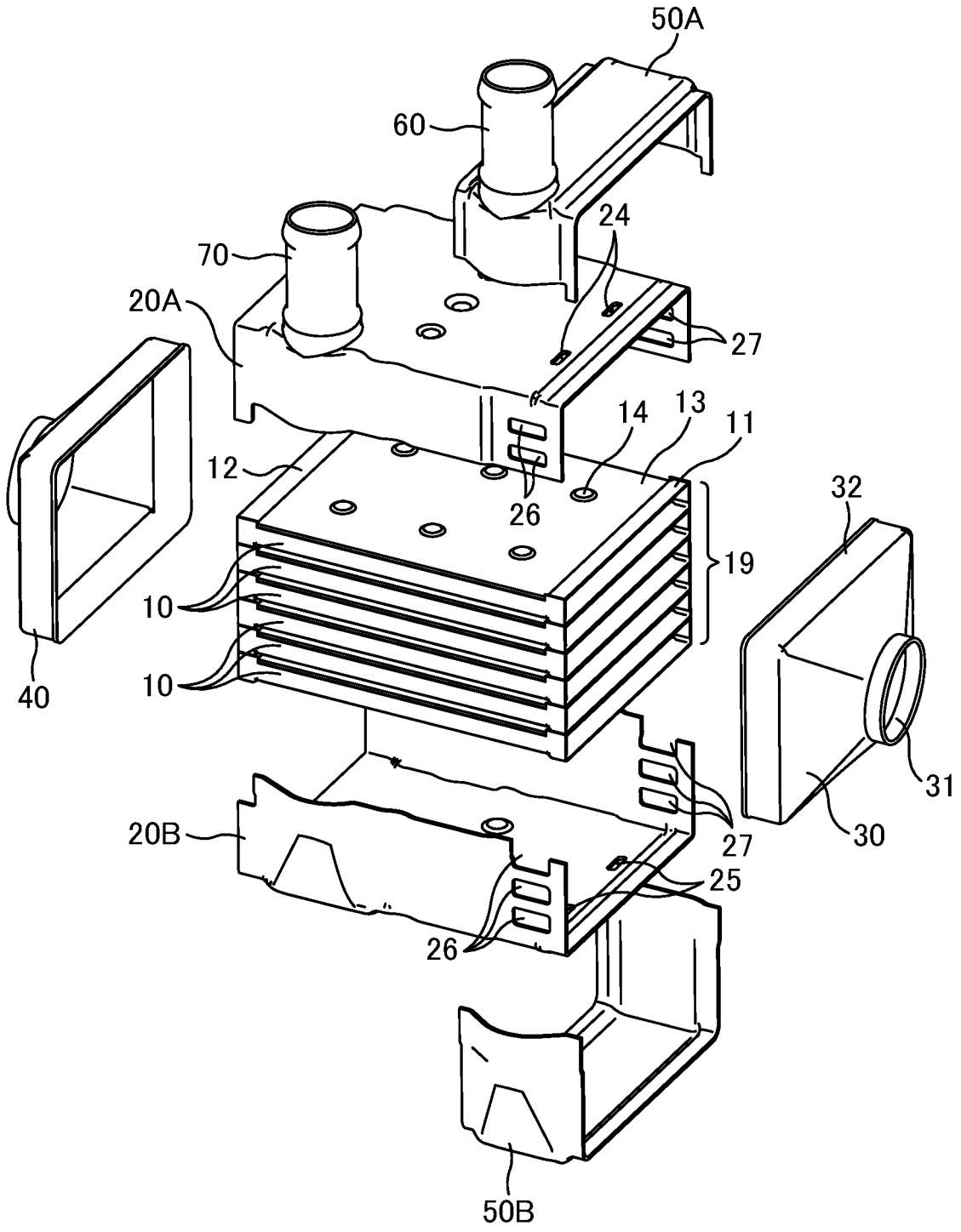
FIG. 7 is an exploded perspective view illustrating a heat exchanger.

FIG. 1 is a plan view illustrating a heat exchanger 1, and FIG. 2 is a side view illustrating the heat exchanger 1. FIGS. 3, 4, and 5 are a cross-sectional view taken along line III-III, a cross-sectional view taken along line IV-IV, and a cross-sectional view taken along line V-V, respectively. FIGS. 6 and 7 are exploded perspective views illustrating the heat exchanger 1.

The heat exchanger 1 is provided in an exhaust gas recirculation system, for example, and used as a gas cooler. Specifically, exhaust gas from an internal combustion engine such as a diesel engine and a gasoline engine is cooled by the heat exchanger 1 and then supplied again to the inlet side of the internal combustion engine.

As illustrated in FIGS. 1 to 7, the heat exchanger 1 includes plural tubes 10, plural inner fins 18, an inner tank 20, an entrance tank 30, an exit tank 40, an outer tank 50, an inlet pipe 60, and an outlet pipe 70. A material of these members 10, 18, 20, 30, 40, 50, 60, and 70 is a SUS material and the like, for example, and these members 10, 18, 20, 30, 40, 50, 60, and 70 have high heat conductivity. Joint parts which will be described later are joined by welding or brazing, for example.

In the following descriptions, the side of the entrance tank 30 refers to the "front side", the side of the exit tank 40 refers to the "rear side", the side to which the inlet pipe 60 and the outlet pipe 70 protrude refers to the "upper side", the side opposite thereto refers to the "lower side", and the right side and the left side when viewing from the front side to the rear side refer to the "right side" and the "left side", respectively. Note that, the direction from the upper side to the lower side is not necessarily the direction of gravity.

1-1. Tube and Inner Fin

Figure 8:
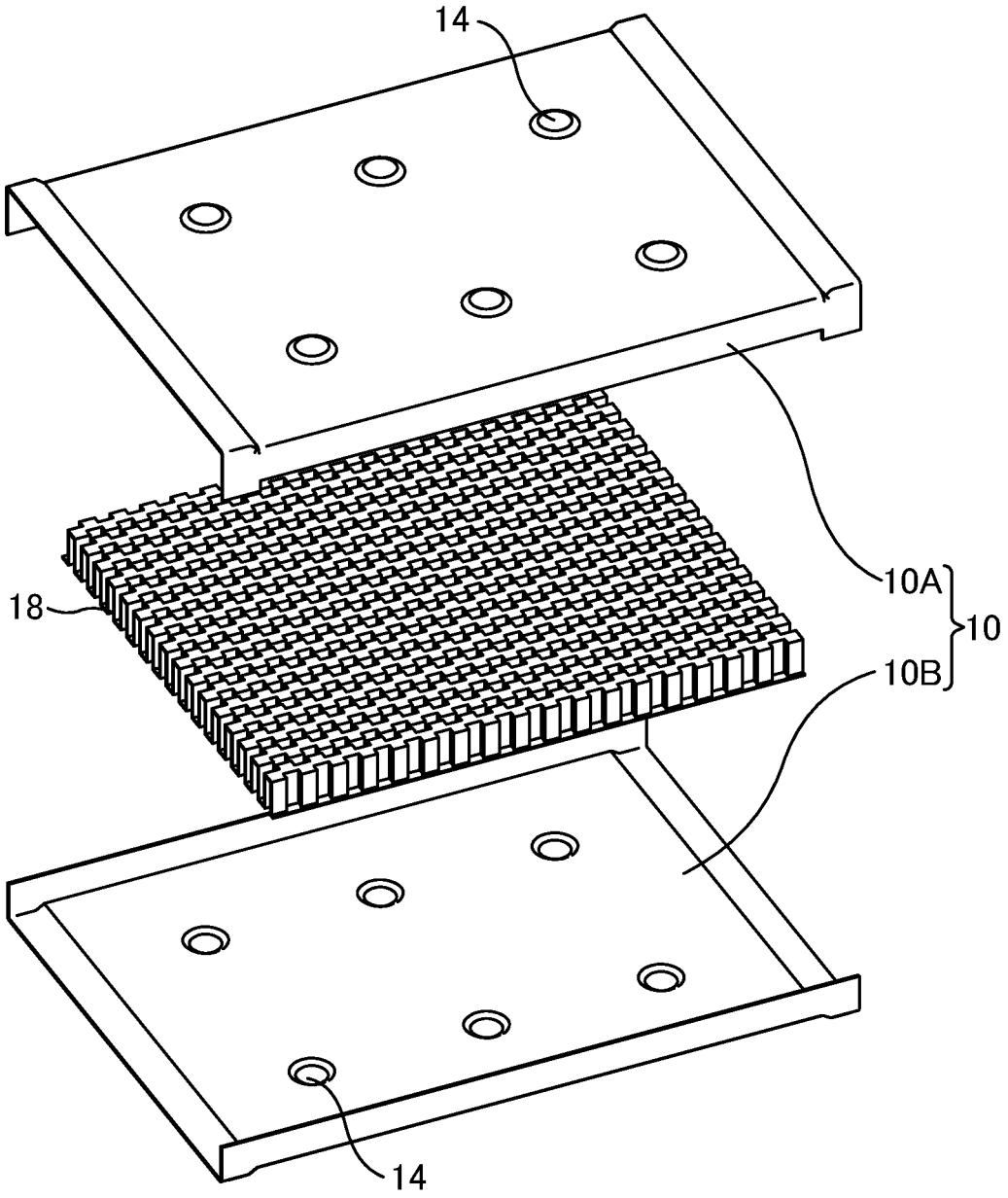
FIG. 8 is an exploded perspective view illustrating a tube and an inner fin.

FIG. 8 is an exploded perspective view illustrating the tube 10 and the inner fin 18. As illustrated in FIGS. 4 and 8, the tube 10 is formed in a tubular shape that has a flat rectangular-shaped cross-section orthogonal to the longitudinal direction (front-rear direction) of the tube 10, and the width (right-left length) of the tube 10 is greater than the thickness (top-bottom length) of the tube 10. Specifically, the tube 10 is configured such that two tube plates 10A, 10B each having a square U-shaped (U-shaped, groove-shaped) cross-section formed by presswork, rolling processing, and/or the like are joined together with their openings facing each other. The inner space of the tube 10 forms a flow path through which the gas flows.

A wavy inner fin 18 is disposed inside the tube 10, and the inner fin 18 and the inner surfaces of the tube 10 are joined together. In this embodiment, the inner fin 18 is an offset fin; however, the inner fin 18 may be a corrugated fin, a wavy fin, or a louver fin.

As illustrated in FIGS. 6 and 7, a front end portion 11 and a rear end portion 12 of the tube 10 has a thickness (top-bottom direction) greater than a middle portion 13 located therebetween. Thus, upper surfaces and lower surfaces of the both end portions 11 and 12 of the tube 10 bulge out more than the upper surface and the lower surface of the middle portion 13, and the upper surface and the lower surface of the middle portion 13 are recessed. Plural protruding portions 14 are formed on the upper surface and the lower surface of the middle portion 13 of the tube 10, and the back sides of the protruding portions 14 are formed such that corresponding parts on the inner surface of the tube 10 are recessed.

As illustrated in FIGS. 4 to 7, these tubes 10 are stacked in the thickness direction (top-bottom direction). In the tubes 10 adjacent to each other, the lower surface of the upper tube 10 and the upper surface of the lower tube 10 face each other. The end portions 11 of the adjacent tubes 10 are joined together and the end portions 12 of the adjacent tubes 10 are joined together, while the middle portions 13 of the adjacent tubes 10 (in the parts thereof except the protruding portions 14) are apart from each other in the top-bottom direction. Thus, a clearance 91 is formed between the middle portions 13 of the adjacent tubes 10, and the clearance 91 forms a flow path that allows a coolant (cooling liquid) to flow therethrough.

Hereinafter, the stack body of the tubes 10 is referred to as a tube stack 19.

1-2. Inner Tank

As illustrated in FIGS. 4 to 7, the inner tank 20 is formed in a rectangular-tubular shape. The inner tank 20 is a joined body including two half bodies 20A and 20B. Specifically, the half bodies 20A and 20B are each formed to have a square-U shaped (U shaped, groove shaped) cross-section by presswork, rolling processing, and/or the like, and the half bodies 20A and 20B are joined together in a state where the openings of the half bodies 20A and 20B face each other and the lower end portion of the upper half body 20A nests in the upper end portion of the lower half body 20B.

The inner tank 20 houses a tube stack 19. A front end portion 21 and a rear end portion 22 of the inner tank 20 are open, the inner peripheral surface of the front end portion 21 is joined to the entire periphery of the outer peripheral surface of the front end portion in the tube stack 19, and the inner peripheral surface of the rear end portion 22 is joined to the entire periphery of the outer peripheral surface of the rear end portion in the tube stack 19. The upper surface of the middle portion 13 of the uppermost tube 10 is partially apart from the inner surface of the inner tank 20 *s* as to form a clearance 92 therebetween. This clearance 92 forms a flow path that allows the coolant to flow therethrough. Likewise, the lower surface of the middle portion 13 of the lowermost tube 10 is partially apart from the inner surface of the inner tank 20 so as to form a clearance 93 therebetween. This clearance 93 forms a flow path through which the coolant flows.

Plural communication holes 24 are formed in the front part of the upper surface of the inner tank 20, and plural communication holes 25 are formed in the front part of the lower surface of the inner tank 20. Plural communication holes 26 are formed in the front part of the left side surface of the inner tank 20, and plural communication holes 27 are formed in the front part of the right side surface of the inner tank 20.

These communication holes 24 to 27 are arranged in a peripheral direction at slightly rear of the joint part of the front end portion of the tube stack 19 and the front end portion 21 of the inner tank 20.

As illustrated in FIGS. 1 to 3 and 5, a bulging portion 23 bulging outward is formed on rear parts of the upper surface, left side surface, and lower surface of the inner tank 20. The bulging portion 23 is arranged on the front side relative to the joint part of the rear end portions 12 of the tubes 10 and the rear end portion 22 of the inner tank 20. A distance between the inner surface of the bulging portion 23 and the outer surface of the tube stack 19 is greater than a distance between the inner surface of the inner tank 20 other than the bulging portion 23 and the outer surface of the tube stack 19.

A discharge hole 29 is formed in the upper surface of the bulging portion 23. The discharge hole 29 is arranged close to the left edge of the upper surface of the bulging portion 23. Thus, as illustrated in FIGS. 1 and 5, the discharge hole 29 partially protrudes to the left from the left side-surface of the tube stack 19, and the left side-surface of the middle portion 13 of the tube 10 extends in the front-rear direction across the discharge hole 29 when viewed from above.

1-3. Outlet Pipe

As illustrated in FIGS. 1, 5, and the like, the outlet pipe 70 is coupled to the discharge hole 29 of the inner tank 20. The outlet pipe 70 protrudes upward from the upper surface of the inner tank 20.

1-4. Entrance Tank

As illustrated in FIGS. 1 to 3, 6, and 7, the entrance tank 30 is formed in a hollow pyramid shape. The front-side top portion of the entrance tank 30 is open, and a rear-side bottom portion of the entrance tank 30 is open as well. The exhaust gas from the internal combustion engine is introduced into the entrance tank 30 through a front-side opening 31 of the entrance tank 30.

Figure 9:
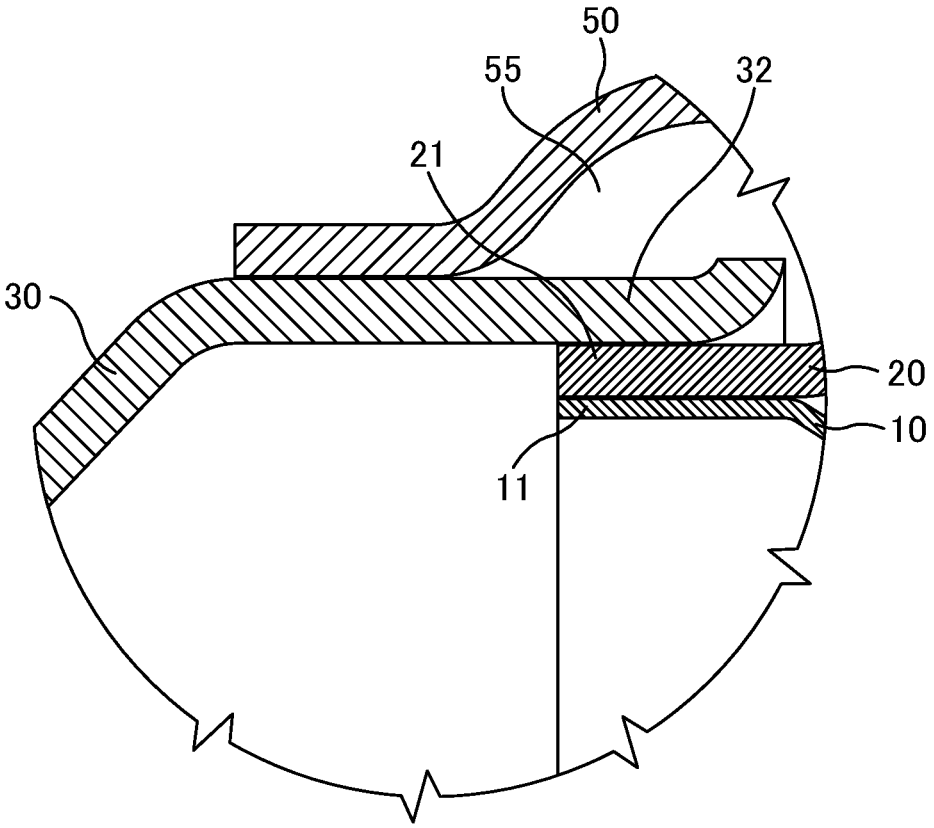
FIG. 9 is an enlarged view illustrating a IX region of FIG. 3.

FIG. 9 is an enlarged view illustrating the IX region of FIG. 3. As illustrated in FIGS. 3 and 9, the inner peripheral surface of a rear end portion 32 of the entrance tank 30 is joined to the outer peripheral surface of the front end portion 21 of the inner tank 20, in a state where the front end portion 21 of the inner tank 20 nests in the rear end opening of the entrance tank 30.

Note that a flange (not shown) is mounted to the outer peripheral portion of the front end portion of the entrance tank 30.

1-5. Outer Tank

As illustrated in FIGS. 1 to 4, 6, and 7, the outer tank 50 is formed in a rectangular-tubular shape. The outer tank 50 is a joined body including two half bodies 50A and 50B. Specifically, the half bodies 50A and 50B are each formed to have a square U-shaped (U-shaped, groove-shaped) cross-section by presswork, rolling processing, and/or the like, and the half bodies 50A and 50B are joined together in a state where the openings of the half bodies 50A and 50B face each other and the lower end portion of the upper half body 50A nests in the upper end portion of the lower half body 50B.

As illustrated in FIGS. 1 to 3, the inner tank 20 is inserted into the outer tank 50, and the inner peripheral surface of the rear end portion of the outer tank 50 is joined to the outer peripheral surface of the inner tank 20. Since the total length of the outer tank 50 is shorter than that of the inner tank 20, a rear portion of the inner tank 20 protrudes and is exposed from the rear end portion of the outer tank 50.

As illustrated in FIGS. 3 and 9, the outer peripheral surface of the rear end portion 32 of the entrance tank 30 is joined to the inner peripheral surface of the front end portion of the outer tank 50 in a state where the rear end portion 32 of the entrance tank 30 nests in the opening of the front end portion of the outer tank 50. As illustrated in FIGS. 3 and 4, the middle portion of the outer tank 50 bulges outward more than the front end portion and the rear end portion thereof, and an inner space 55 is formed between the middle portion of the outer tank 50 and the inner tank 20. Thus, as illustrated in FIGS. 3 and 9, the rear end portion 32 of the entrance tank 30 is exposed to the inner space 55, and the front portion of the inner tank 20 is exposed to the inner space 55 as well.

The communication holes 24 to 27 allow the inner space 55 of the outer tank 50 and the interior of the inner tank 20 to communicate with each other. Specifically, the communication holes 24 allow the inner space 55 and the clearance 92 between the uppermost tube 10 and an inner surface of the outer tank 50 to communicate with each other. The communication holes 25 allow the inner space 55 and the clearance 93 between the lowermost tube 10 and the inner surface of the outer tank 50 to communicate with each other. The communication holes 26 and 27 are arranged at positions corresponding to the clearances 91 between the tubes 10 adjacent to each other, while the communication holes 26 are arranged on the left of the clearances 91 and the communication holes 27 are arranged on the right of the clearances 91 so that the communication holes 26 and the communication holes 27 face each other with the clearances 91 arranged therebetween (see FIG. 4).

An introduction hole 51 is formed in the upper surface of the outer tank 50. The introduction hole 51 is arranged close to the left edge of the upper surface of the outer tank 50. Thus, as illustrated in FIGS. 1 and 4, the introduction hole 51 partially protrudes to the left from the left side surface of the inner tank 20, and the left side surface of the inner tank 20 extends in the front-rear direction across the introduction hole 51 when viewed from above.

Any of the communication holes 24 to 27 formed in the inner tank 20 is also offset from a position at which the communication hole faces the introduction hole 51.

1-6. Inlet Pipe

As illustrated in FIGS. 1, 4, and the like, the inlet pipe 60 is coupled to the introduction hole 51 of the outer tank 50. The inlet pipe 60 protrudes upward from the upper surface of the outer tank 50. The coolant is introduced into the outer tank 50 through the inlet pipe 60.

1-7. Exit Tank

As illustrated in FIGS. 1 to 3, 6, and 7, the exit tank 40 is formed in a hollow pyramid shape. The front-side bottom portion of the exit tank 40 is open, and the rear-side top portion of the exit tank 40 is open as well.

The inner peripheral surface of the front end portion of the exit tank 40 is joined to the outer peripheral surface of the rear end portion 22 of the inner tank 20, in a state where the rear end portion 22 of the inner tank 20 nests in the front-side opening of the exit tank 40.

Note that a flange (not shown) is mounted to the outer peripheral portion of the rear end portion of the exit tank 40.

2. Gas Flow

The exhaust gas from the internal combustion engine is introduced into the entrance tank 30 through the front-side opening 31 of the entrance tank 30 (see the arrow A shown in FIG. 3). The exhaust gas is distributed to the inside of each tube 10. In the tube 10, the exhaust gas flows from the front end portion 11 to the rear end portion 12 of the tube 10 while the exhaust gas is in contact with the inner fin 18. The exhaust gas is then discharged from the exit tank 40 through the rear-side opening 41 (see the arrow B shown in FIG. 3) and is supplied again to the inlet side of the internal combustion engine.

3. Coolant Flow

The coolant is introduced into the outer tank 50 through the inlet pipe 60 and the introduction hole 51. Since the inlet pipe 60 and the introduction hole 51 partially protrudes to the left from the left side-surface of the inner tank 20, the coolant introduced to the outer tank 50 flows downward along the side of the left side-surface of the inner tank 20 (see the arrow C shown in FIG. 4) and flows to the right after hitting the upper surface of the inner tank 20 (see the arrow D shown in FIG. 4). Accordingly, the coolant reaches the whole inner space 55 of the outer tank 50.

As illustrated in FIGS. 3 and 9, since the rear end portion 32 of the entrance tank 30 is in contact with the coolant in the inner space 55, heat is exchanged between the gas in the entrance tank 30 and the coolant in the inner space 55, thereby cooling the gas before flowing into the tubes 10.

Since the outer tank 50 surrounds the front portions of the inner tank 20 and the tube stack 19, and the coolant reaches the whole inner space 55 of the outer tank 50, heat is exchanged between the gas inside the front portions of the tubes 10 and the coolant in the inner space 55.

Incidentally, since the coolant introduced into the heat exchanger 1 has the lowest temperature in the inner space 55, the rear end portion 32 of the entrance tank 30 in contact with the coolant in the inner space 55 is likely to be cooled. On the other hand, since the gas is introduced into the entrance tank 30, the temperature of the front portion of the entrance tank 30 is high. Accordingly, the entrance tank 30 has a temperature gradient in which the temperature thereof decreases from the front side thereof to the rear side thereof. In addition, as illustrated in FIG. 9, the rear end portion 32 of the entrance tank 30 that is likely to be cooled by the coolant is in contact with not only the coolant but also the outer tank 50 and the inner tank 20, and thus the temperature gradient in the entrance tank 30 is gentle. This can prevent damage to the entrance tank 30 due to the temperature gradient.

The coolant introduced into the outer tank 50 flows into the inner tank 20 through the communication holes 24 to 27. Specifically, the coolant flows into the clearance 92 between the uppermost tube 10 and the inner surface of the outer tank 50 through the communication holes 24. The coolant flows into the clearance 93 between the lowermost tube 10 and the inner surface of the outer tank 50 through the communication holes 25. The coolant flows into the clearances 91 each between the tubes 10 adjacent to each other through the communication holes 26 and 27.

Here, the inner space 55 of the outer tank 50 is formed along the entire periphery of the inner tank 20, and the communication holes 24 to 27 are arranged in the peripheral direction as described above, and thus the coolant passes through any of the communication holes 24 to 27 at a uniform flow rate. Since neither of the communication holes 26 on the left nor the communication holes 27 on the right face the introduction hole 51, the flow rate of the coolant passing through the communication holes 26 and the flow rate of the coolant passing through the communication holes 27 are equal to each other.

The coolant having flown in the clearances 91, 92, and 93 flows toward the rear side. Heat is exchanged between the coolant in the clearances 91, 92, and 93 and the gas in the tubes 10, thereby cooling the gas in the tubes 10.

Since the flow path of the coolant is narrowed by the communication holes 24 to 27, a flow speed of the coolant in the clearances 91, 92, and 93 is higher. This makes it possible to inhibit the coolant from being stagnated in the clearances 91, 92, and 93. Particularly, since the coolant flows into the clearances 91 from the communication holes 26 and 27 on both sides, the coolant is hardly stagnated in the clearances 91. In addition, since the flow rates of the coolant in the communication holes 26 and 27 are equal to each other, it is possible to further inhibit occurrence of such stagnation.

Accordingly, the coolant in the clearances 91, 92, and 93 is not excessively heated, thereby being able to inhibit boiling of the coolant. Further, the temperature distribution in the tubes 10 becomes uniform, thereby being able to prevent damage to the tubes 10 due to non-uniformity of the temperature distribution can be prevented.

4. Verification

Figure 10:
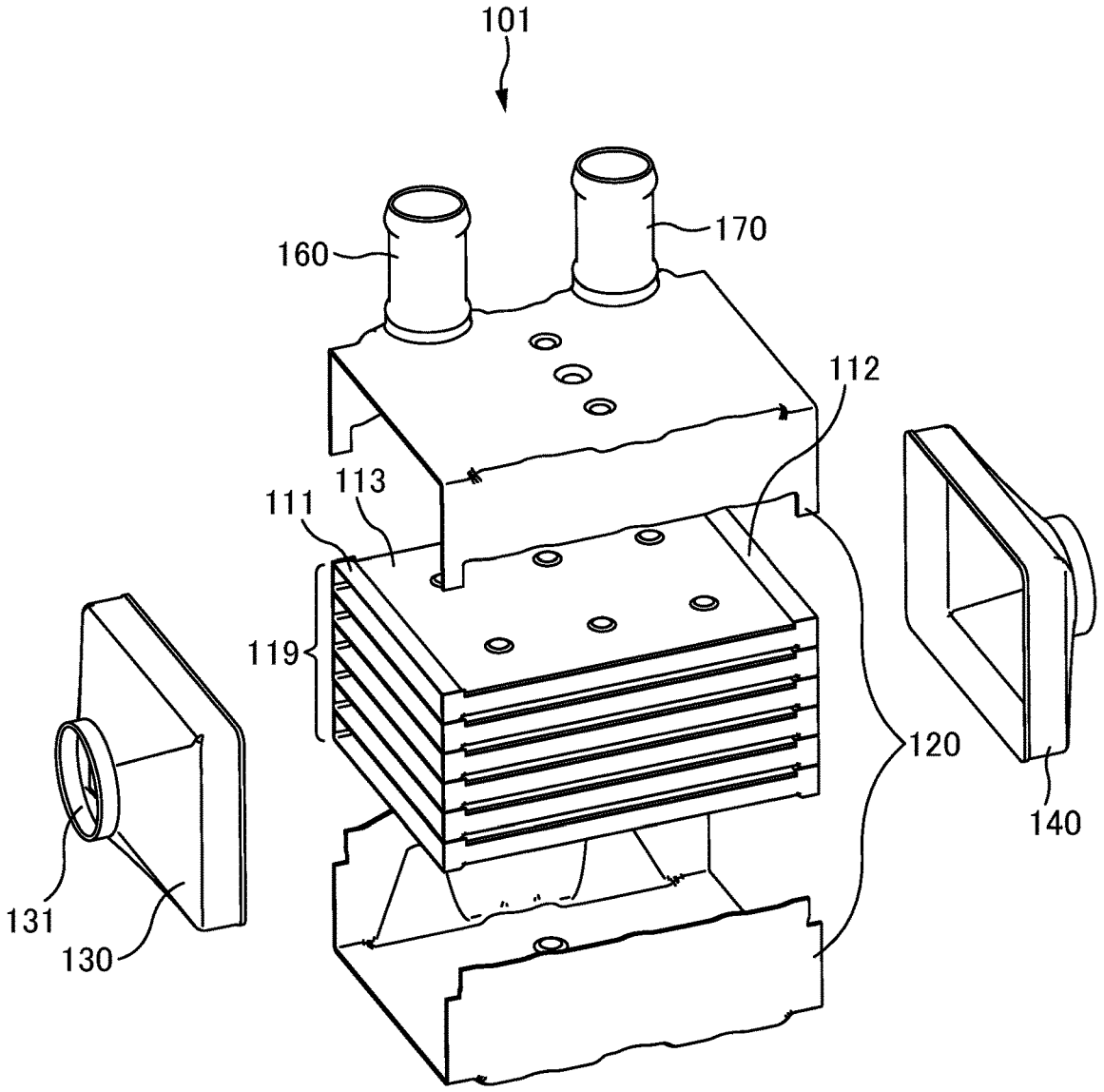
FIG. 10 is an exploded perspective view illustrating a heat exchanger of a comparative example.
Figure 11:
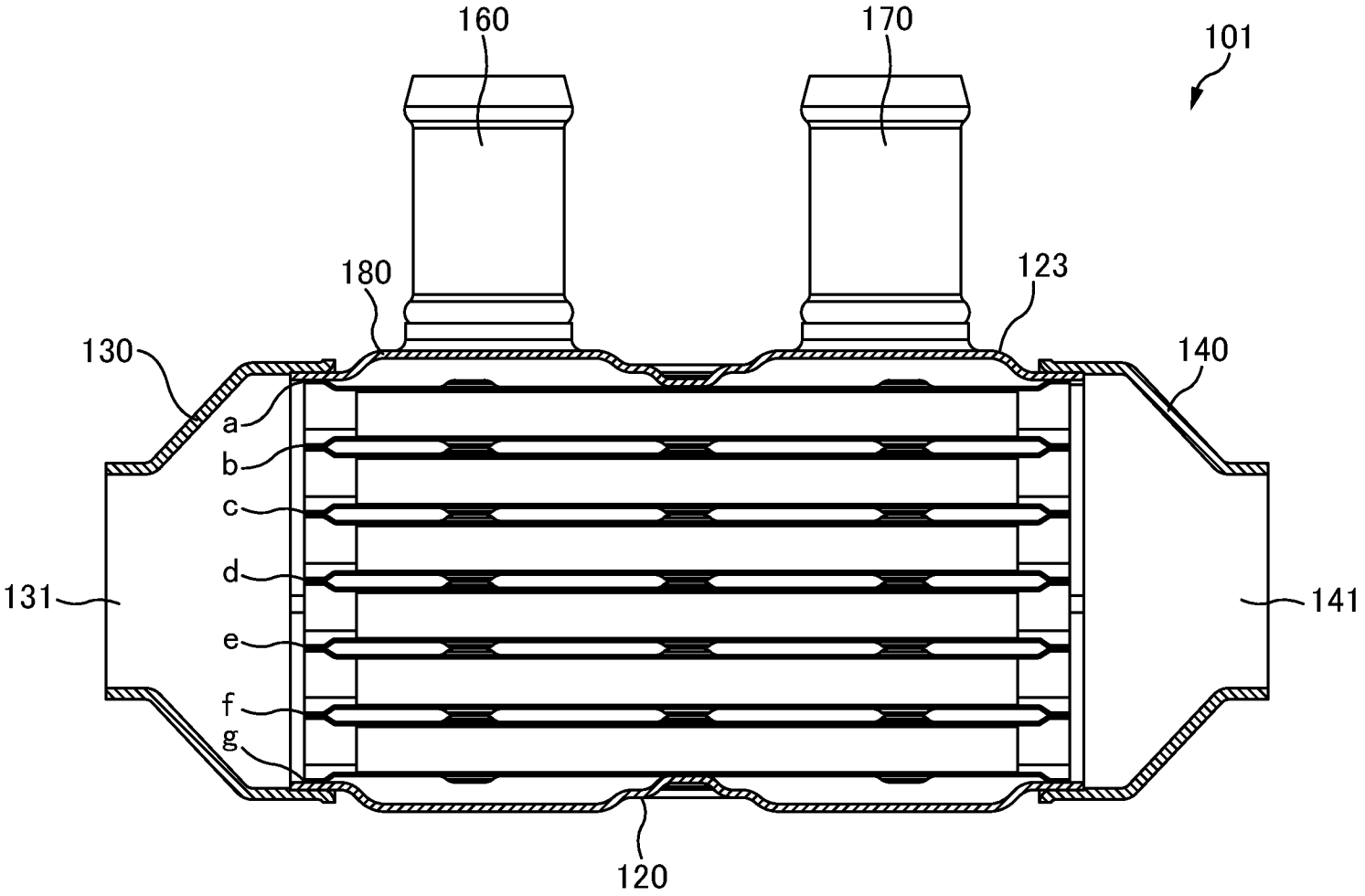
FIG. 11 is a cross sectional view of a heat exchanger of a comparative example.
Figure 12:
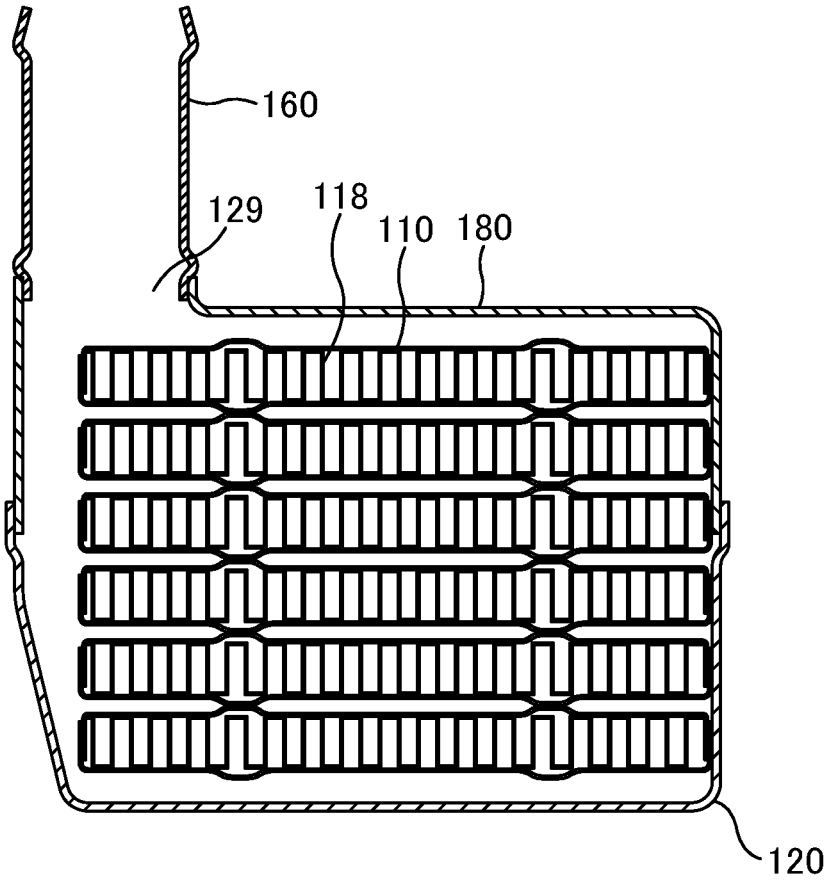
FIG. 12 is a cross sectional view illustrating a heat exchanger of a comparative example.

By comparing the heat exchanger 1 of the above-described embodiment with a heat exchanger 101 of a comparative example illustrated in FIGS. 10 to 12, it is verified that the heat exchanger 1 has higher cooling efficiency than the heat exchanger 101.

Differences between the heat exchanger 1 of the above-described embodiment and the heat exchanger 101 of the comparative example will be described in the following. Except for the differences described below, the heat exchanger 1 of the embodiment and the heat exchanger 101 of the comparative example are similarly configured. Note that the portions in the heat exchanger 101 of the comparative example that correspond to those in the heat exchanger 1 of the embodiment are given the reference numbers that have common numbers in the last two digits.

Although the heat exchanger 1 of the embodiment includes the outer tank 50, the heat exchanger 101 of the comparative example includes no such a component as to be equivalent to the outer tank 50. That is, as illustrated in FIGS. 10 to 12, in the heat exchanger 101 of the comparative example, a bulging portion 180 bulging outward is formed on the front parts of the upper surface, left side surface, and lower surface of an inner tank 120, and a pipe hole 129 is formed in the upper surface of the bulging portion 180, and an inlet pipe 160 is coupled to the pipe hole 129. The pipe hole 129 is arranged close to the left edge of the upper surface of the bulging portion 180.

In the heat exchanger 1 of the embodiment, the communication holes 24 to 27 are formed in the outer tank 50, whereas, in the heat exchanger 101 of the comparative example, those corresponding to the communication holes 24 to 27 are not formed in the outer tank 150.

Fluid analysis/heat exchange analysis of the heat exchangers 1, 101 described above have been conducted. Conditions of the analyses are as follows: the temperature of the gas introduced into openings 31, 131 of entrance tanks 30, 130 is set at 780° C.; a mass flow rate of the gas is set at 10 g/s; the temperature of the coolant (cooling water) introduced into inlet pipes 60, 160 is set at 90° C.; and a volume flow rate of the coolant is set at 8 L/min.

Figure 13:
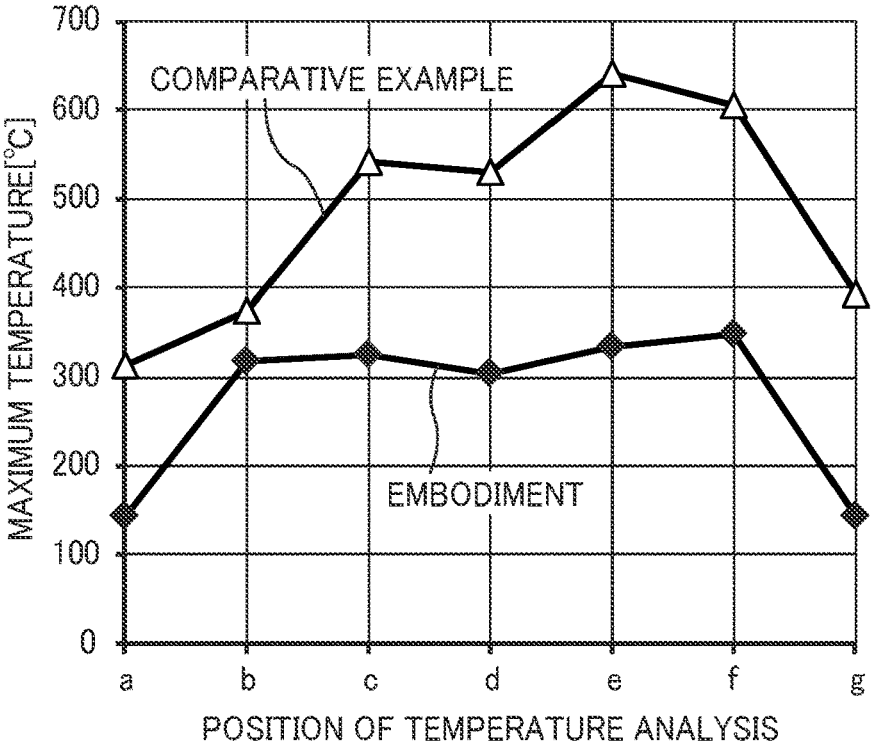
FIG. 13 is a graph for comparing an analysis result of an embodiment with an analysis result of a comparative example.

The maximum temperatures in temperature distributions in a to g parts (front ends of tubes 10, 110) illustrated in FIGS. 3 and 11 are calculated by the fluid analysis/heat exchange analysis. The calculated results are shown in FIG. 13. As apparent from FIG. 13, it can be seen that the temperatures in the a to g parts are lower in the heat exchanger 1 of the embodiment than the heat exchanger 101 of the comparative example. Thus, the heat exchanger 1 of the embodiment is superior in cooling of the gas.

Figure 14:
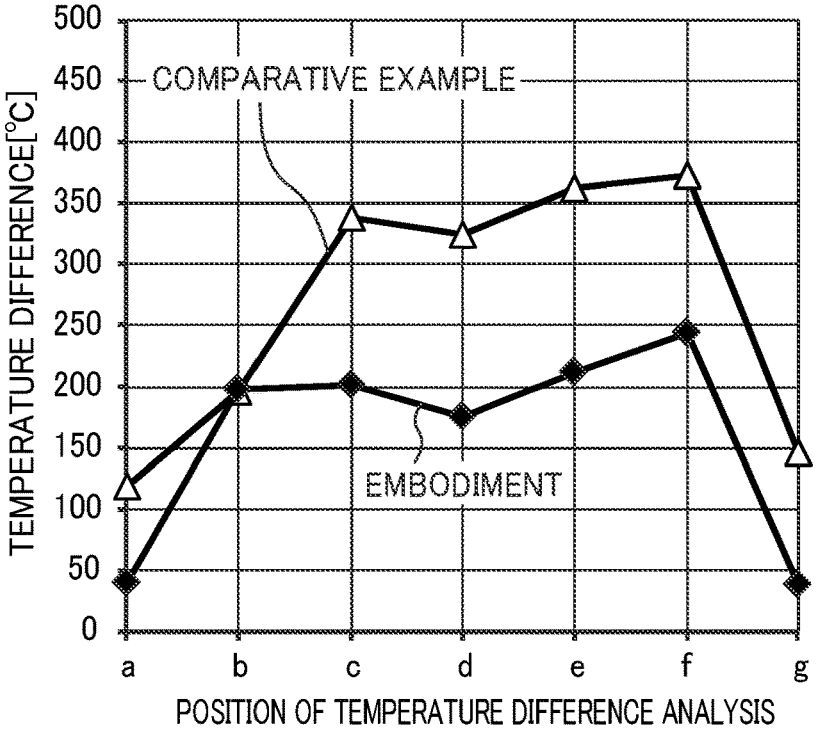
FIG. 14 is a graph for comparing an analysis result of an embodiment with an analysis result of a comparative example.

In addition, differences between the maximum temperatures and the minimum temperatures in the temperature distributions in the a to g parts are calculated by the fluid analysis/heat exchange analysis. The calculated results are shown in FIG. 14. As apparent from in FIG. 14, it can be seen that the temperature differences in the c to g parts are smaller in the heat exchanger 1 of the embodiment than in the heat exchanger 101 of the comparative example. Thus, the heat exchanger 1 of the embodiment has more uniform temperature distributions in the tubes 10 and higher effects of preventing damage to the tubes 10 than the heat exchanger 101 of the comparative example.

5. Modifications

Although an embodiment of the present disclosure is described above, an embodiment described above is simply to facilitate understanding of the present disclosure and are not in any way to be construed as limiting the present disclosure. An embodiment of the present disclosure may variously be changed or altered without departing from its gist and encompass equivalents thereof. Modifications made from an embodiment described above will be explained as follows.

(1) FIGS. 15 to 20 are right side views illustrating the inner tank 20 inside the outer tank 50.

Figure 15:
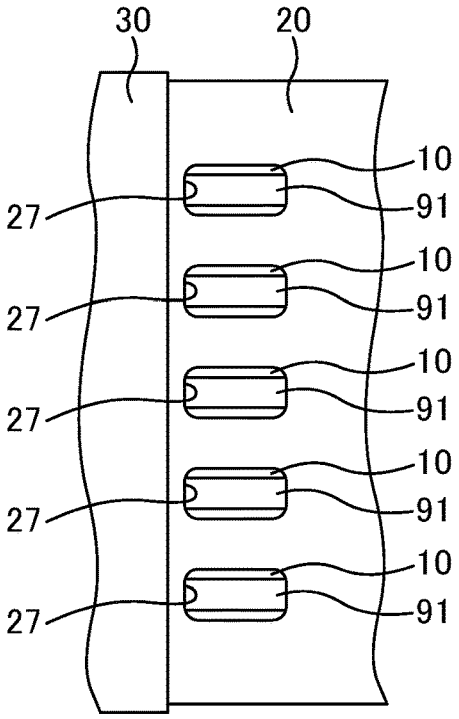
FIG. 15 is a side view illustrating an inner tank of a heat exchanger in a first modification.

As illustrated in FIG. 15, any of the communication holes 27 may have the same area (front-rear length and top-bottom length). The same applies to the communication holes 26 on the opposite side.

Figure 16:
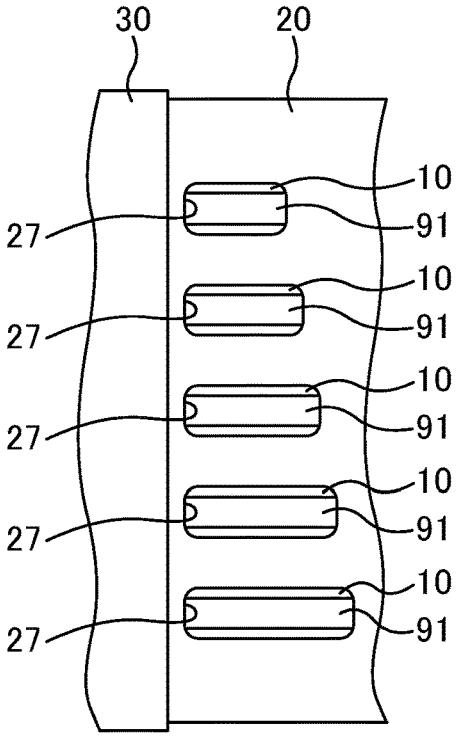
FIG. 16 is a side view illustrating an inner tank of a heat exchanger in a second modification.

As illustrated in FIG. 16, the areas of the communication holes 27 decrease in the order from bottom to top. The same applies to the communication holes 26 on the opposite side. Note that all the communication holes 26 and 27 corresponding to each other have the same front-rear length, respectively.

Figure 17:
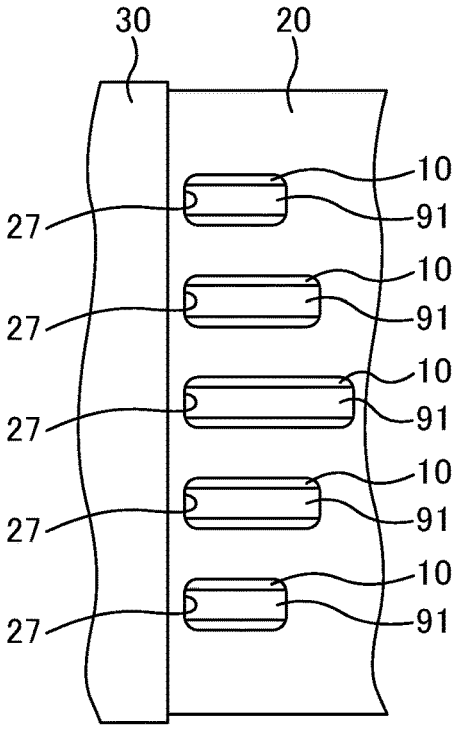
FIG. 17 is a side view illustrating an inner tank of a heat exchanger in a third modification.

As illustrated in FIG. 17, one of the communication holes 27 arranged in the center has the greatest area, the areas of the communication holes 27 above the center communication hole 27 increase in the order from top to bottom, and the areas of the communication holes 27 below the center communication hole 27 increase in the order from bottom to top. The same applies to the communication holes 26 on the opposite side. Note that all the communication holes 26 and 27 corresponding to each other have the same front-rear length, respectively.

Figure 18:
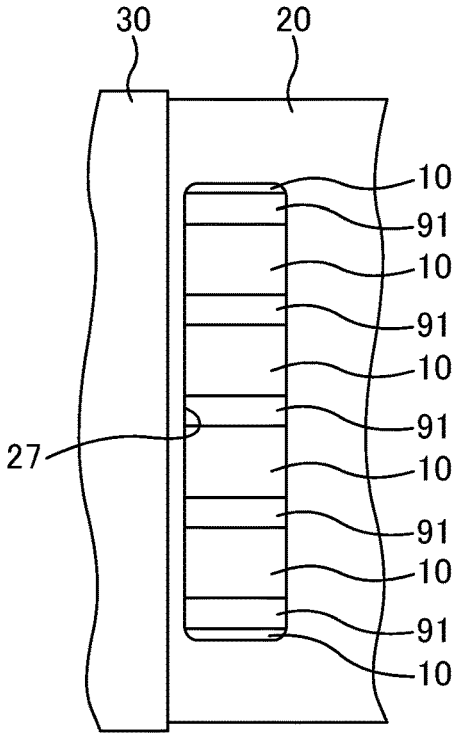
FIG. 18 is a side view illustrating an inner tank of a heat exchanger in a fourth modification.
Figure 19:
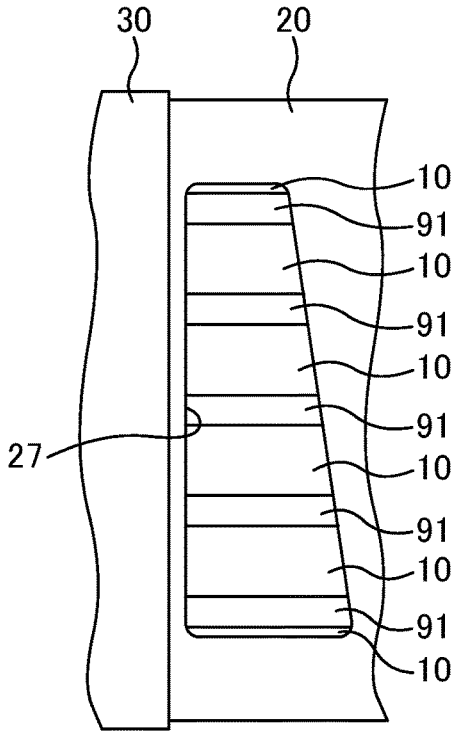
FIG. 19 is a side view illustrating an inner tank of a heat exchanger in a fifth modification.
Figure 20:
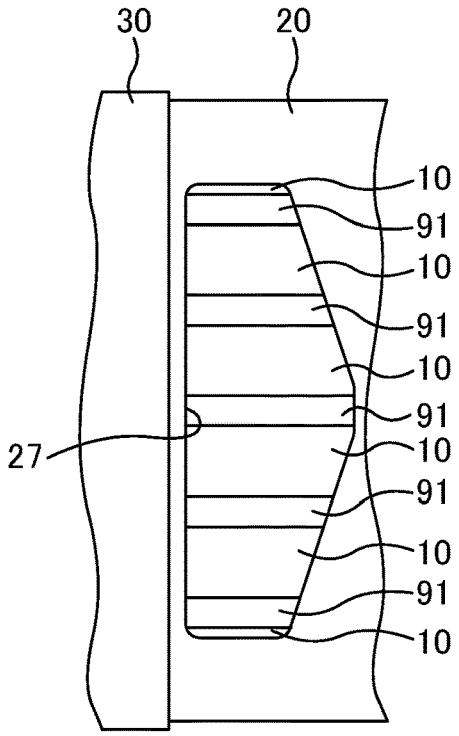
FIG. 20 is a side view illustrating an inner tank of a heat exchanger in a sixth modification.

As illustrated in FIGS. 18 to 20, a single communication hole 27 may be formed to be elongated in the top-bottom direction, and the communication hole 27 may communicate with plural clearances 91. The same applies to the communication hole 26 on the opposite side. In this case, the front-rear lengths of the communication hole 27 illustrated in FIG. 18 and the communication hole 26 on the opposite side are uniform. The front-rear lengths of the communication hole 27 and the opposite communication hole 26 illustrated in FIG. 19 gradually decrease from bottom to top. The front-rear lengths of the communication hole 27 illustrated in FIG. 20 and the communication hole 26 on the opposite side gradually increase from top to the center and gradually decrease from the center to bottom.

(2) In an embodiment described above, the heat exchanger 1 is used as a gas cooler in an exhaust gas recirculation system, however, the heat exchanger 1 may be provided in a system other than the exhaust gas recirculation system as long as the heat exchanger 1 is used as a gas cooler for cooling gas using a cooling medium that is cooler than the gas.

REFERENCE SIGNS LIST

1 heat exchanger
10 tube
11 front end portion of tube
12 rear end portion of tube
13 middle portion of tube
19 tube stack
20 inner tank
21 front end portion of inner tank
22 rear end portion of inner tank
26, 27 communication hole
29 discharge hole
30 entrance tank
50 outer tank
51 introduction hole
55 inner space
91 clearance

The invention claimed is:

1. A heat exchanger, comprising:

a stack formed by stacking a plurality of tubes through which gas flow;

a tubular inner tank in which the stack is housed; and a tubular outer tank that is mounted on the outside of the inner tank so as to define an inner space between the outer tank and an outer peripheral surface of the inner tank, wherein each of both end portions of the tubes has a thickness greater than each of middle portions of the tubes, the both end portions of the tubes adjacent to each other in the stack are joined together so as to form a clearance between the middle portions of the adjacent tubes in the stack, outer peripheries of both end portions of the stack are joined to an inner peripheral surface of the inner tank, an introduction hole for introducing a cooling medium is formed in the outer tank, a discharge hole for discharging the cooling medium is formed at a location between the both end portions of the tubes in the inner tank, and a communication hole allowing the clearance and the inner space to communicate with each other is formed in each of both side surfaces of the inner tank positioned inside the outer tank.

2. The heat exchanger according to claim 1, wherein the communication hole is offset from a position in which the communication hole faces the introduction hole.

3. The heat exchanger according to claim 1, further comprising:

a hollow entrance tank including both end portions that are open, wherein the outer periphery of one end portion of the stack is joined to the inner peripheral surface of one end portion of the inner tank, gas is introduced into an opening of one end portion of the entrance tank, an outer peripheral surface of the one end portion of the inner tank is joined to an inner peripheral surface of the other end portion of the entrance tank, in a state where the one end portion of the inner tank is inserted in an opening of the other end portion of the entrance tank, an outer peripheral surface of the other end portion of the entrance tank is joined to an inner peripheral surface of one end portion of the outer tank, in a state where the other end portion of the entrance tank is inserted in an opening of the one end portion of the outer tank, the inner peripheral surface of the other end portion of the outer tank is joined to the outer peripheral surface of the inner tank, a exposed part of the inner tank protrudes from the other end portion of the outer tank, and the discharge hole is formed in the exposed part of the inner tank.

4. The heat exchanger according to claim 1, wherein the introduction hole is arranged close to one side surface of the inner tank, and the one side surface of the inner tank extends across the introduction hole when viewed through the introduction hole.

* * * * *